US009695812B2

(12) United States Patent
Dille et al.

(10) Patent No.: US 9,695,812 B2
(45) **Date of Patent: *Jul. 4, 2017**

(54) RECIPROCATING PUMP ASSEMBLY

(71) Applicant: S.P.M. Flow Control, Inc., Fort Worth, TX (US)

(72) Inventors: Mark C. Dille, Fort Worth, TX (US); David Arnoldy, Fort Worth, TX (US); Wesley D. Freed, Fort Worth, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 239 days.

This patent is subject to a terminal disclaimer.

(21) Appl. No.: 14/262,880

(22) Filed: Apr. 28, 2014

(65) Prior Publication Data

US 2016/0363115 A1 Dec. 15, 2016

Related U.S. Application Data

(63) Continuation of application No. 13/843,525, filed on Mar. 15, 2013, now Pat. No. 8,707,853.

(51) Int. Cl.

| | |
|---|---|
| ***F04B 39/00*** | (2006.01) |
| ***F04B 53/14*** | (2006.01) |
| ***F04B 53/16*** | (2006.01) |

(52) U.S. Cl.

CPC ..... *F04B 39/0005* (2013.01); *F04B 39/0022* (2013.01); *F04B 53/14* (2013.01); *F04B 53/147* (2013.01); *F04B 53/16* (2013.01)

(58) Field of Classification Search

CPC .... F04B 53/14; F04B 53/147; F04B 39/0005; F04B 39/0022; F04B 53/16

See application file for complete search history.

(56) References Cited

U.S. PATENT DOCUMENTS

| | | | |
|---|---|---|---|
| 364,627 | A | 6/1887 | Arnold |
| 879,560 | A | 2/1908 | Lepley |

(Continued)

FOREIGN PATENT DOCUMENTS

| | | | |
|---|---|---|---|
| BR | 8700642 | A | 8/1988 |
| CA | 2486126 | A1 | 10/2005 |

(Continued)

OTHER PUBLICATIONS

Office Action mailed Jul. 16, 2007 re U.S. Appl. No. 10/831,467.

(Continued)

*Primary Examiner* — Logan Kraft
(74) *Attorney, Agent, or Firm* — Gardere Wynne Sewell LLP

(57) ABSTRACT

A reciprocating pump assembly having a power end housing and a fluid end housing and a cylinder having at least a portion within the power end. A plunger assembly reciprocates between the power end housing and the fluid end housing of the pump assembly, the plunger assembly having a crosshead, a first section limited to movement within the power end and a second section moveable within the fluid end housing. The pump assembly also includes a seal housing disposed within the cylinder, the seal housing having a proximal end adjacent an entrance to the cylinder, and a distal end disposed within the cylinder. A power end seal is secured to the seal housing proximate the distal end and a fluid end seal is disposed within the fluid end housing. The power end seal sealingly engages an outer surface of the first section and the fluid end seal sealingly engages an outer surface of the second section such that during the reciprocating movement of the plunger assembly, fluid end proppant is deterred from contaminating the outer surface of the first section and thus, contaminating the power end seal.

20 Claims, 3 Drawing Sheets

(56) References Cited

U.S. PATENT DOCUMENTS 1,418,202 A 5/1922 Parsons
1,707,228 A 4/1929 Knapp
1,867,585 A 7/1932 Moore
1,890,428 A 12/1932 Ferris
1,926,925 A 9/1933 Wescott
2,056,622 A 10/1936 Schaer
2,420,779 A 5/1947 Holmes
2,428,602 A 10/1947 Yingling
2,443,332 A 6/1948 Summers
2,665,555 A 1/1954 Martinsson
2,682,433 A 6/1954 Maier
2,708,144 A * 5/1955 Carr ..... F04B 53/147 403/108
2,755,739 A 7/1956 Euwe
2,766,701 A 10/1956 Giraudeau
2,823,085 A 2/1958 Keylwert
2,828,931 A 4/1958 Harvey
2,878,990 A 3/1959 Zurcher
2,991,003 A 7/1961 Peterson
3,039,317 A 6/1962 Wilson
3,049,082 A 8/1962 Barry
3,137,179 A 6/1964 Moorehead
3,158,211 A 11/1964 McCue
3,163,474 A 12/1964 Wilson
3,168,665 A 2/1965 Holper
3,179,451 A 4/1965 Blank
3,206,242 A 9/1965 Fensin
3,207,142 A 9/1965 Gorissen
3,236,315 A 2/1966 Lora
3,356,036 A 12/1967 Repp
3,358,352 A 12/1967 Wilcox
3,487,892 A 1/1970 Kiefer
3,595,101 A 7/1971 Cooper, Sr.
3,757,149 A 9/1973 Holper
3,760,694 A 9/1973 Lieb
3,883,941 A 5/1975 Coil
3,967,542 A 7/1976 Hall et al.
4,013,057 A 3/1977 Guenther
4,048,909 A 9/1977 Jepsen
4,099,447 A 7/1978 Ogles
4,140,442 A 2/1979 Mulvey
4,191,238 A 3/1980 Pichl
4,210,399 A 7/1980 Jain
4,211,190 A 7/1980 Indech
4,246,908 A 1/1981 Inagaki et al.
4,269,569 A 5/1981 Hoover
4,338,054 A 7/1982 Dahl
4,381,179 A 4/1983 Pareja
4,388,837 A 6/1983 Bender
4,476,772 A 10/1984 Gorman et al.
4,477,237 A 10/1984 Grable
4,494,415 A 1/1985 Elliston
4,512,694 A 4/1985 Foran et al.
4,553,298 A 11/1985 Grable
4,606,709 A 8/1986 Chisolm
4,667,627 A 5/1987 Matsui et al.
4,705,459 A 11/1987 Buisine et al.
4,729,249 A 3/1988 Besic
4,762,051 A 8/1988 Besic et al.
4,771,801 A 9/1988 Crump et al.
4,803,964 A 2/1989 Kurek et al.
4,809,646 A 3/1989 Paul et al.
4,824,342 A 4/1989 Buck
4,842,039 A 6/1989 Kelm
4,876,947 A 10/1989 Rhodes
4,887,518 A 12/1989 Hayakawa
4,939,984 A 7/1990 Fletcher-Jones
4,950,145 A 8/1990 Zanetos et al.
4,966,109 A 10/1990 Pusic et al.
5,031,512 A 7/1991 Graziani
5,060,603 A 10/1991 Williams
5,063,775 A 11/1991 Walker, Sr. et al.
5,076,220 A 12/1991 Evans et al.
5,078,580 A 1/1992 Miller et al.
5,080,319 A 1/1992 Nielsen
5,115,725 A 5/1992 Horiuchi
5,135,031 A 8/1992 Burgess et al.
5,156,534 A 10/1992 Burgy et al.
5,216,943 A 6/1993 Adler et al.
5,246,355 A 9/1993 Matzner et al.
5,247,873 A 9/1993 Owens et al.
5,287,612 A 2/1994 Paddock et al.
5,313,061 A 5/1994 Drew et al.
5,337,612 A 8/1994 Evans
5,370,093 A 12/1994 Hayes
5,425,306 A 6/1995 Binford
5,560,332 A 10/1996 Chang
5,594,665 A 1/1997 Walter et al.
5,658,250 A 8/1997 Blomquist et al.
5,671,655 A 9/1997 Vollrath
5,673,666 A 10/1997 Beardmore et al.
5,772,403 A 6/1998 Allison et al.
5,839,888 A 11/1998 Harrison
5,846,056 A 12/1998 Dhindsa et al.
5,855,397 A 1/1999 Black et al.
5,984,645 A 11/1999 Cummings
6,260,004 B1 7/2001 Hays et al.
6,330,525 B1 12/2001 Hays et al.
6,419,459 B1 7/2002 Sibbing
6,557,457 B1 5/2003 Hart et al.
6,663,349 B1 12/2003 Discenzo et al.
6,697,741 B2 2/2004 Yu et al.
6,718,955 B1 4/2004 Knight
D495,342 S 8/2004 Tojo et al.
D496,670 S 9/2004 Ohnishi
6,853,110 B1 2/2005 Durham et al.
6,859,740 B2 2/2005 Stephenson et al.
6,873,267 B1 3/2005 Tubel et al.
6,882,960 B2 4/2005 Miller
6,983,682 B2 * 1/2006 Haughom ..... F16J 15/56 92/160
7,111,604 B1 9/2006 Hellenbroich et al.
D538,824 S 3/2007 Tojo
7,219,594 B2 5/2007 Kugelev et al.
7,220,119 B1 5/2007 Kirchmer et al.
7,272,533 B2 9/2007 Schlosser
7,364,412 B2 4/2008 Kugelev et al.
7,374,005 B2 5/2008 Gray, Jr.
7,404,704 B2 7/2008 Kugelev et al.
D591,311 S 4/2009 Tojo
7,588,384 B2 9/2009 Yokohara
7,610,847 B2 11/2009 McKelroy
7,621,179 B2 11/2009 Ens et al.
7,623,986 B2 11/2009 Miller
7,866,153 B2 1/2011 Sollie et al.
7,931,078 B2 4/2011 Toporowski et al.
8,100,048 B2 1/2012 Christopher
8,162,631 B2 4/2012 Patel et al.
D658,684 S 5/2012 Roman
D668,266 S 10/2012 Ramirez, Jr.
D670,312 S 11/2012 Alexander et al.
D676,875 S 2/2013 Ramirez, Jr.
8,376,723 B2 2/2013 Kugelev et al.
D678,628 S 3/2013 Krueger
D678,911 S 3/2013 Prevost
D682,317 S 5/2013 Carruth et al.
D685,393 S 7/2013 Prevost
8,529,230 B1 9/2013 Colley, III et al.
D692,026 S 10/2013 Alexander et al.
D693,200 S 11/2013 Saunders
D698,502 S 1/2014 Krueger
D700,622 S 3/2014 Carruth et al.
8,707,853 B1 4/2014 Dille et al.
D704,385 S 5/2014 Hoofman
D708,401 S 7/2014 Krueger
D713,101 S 9/2014 Bruno et al.
8,833,301 B2 9/2014 Donegan et al.
8,833,302 B2 9/2014 Donegan et al.
8,857,374 B1 10/2014 Donegan et al.
D759,728 S 6/2016 Byrne et al.
2002/0020460 A1 2/2002 Viken
2002/0189587 A1 12/2002 Hirano
2003/0024386 A1 2/2003 Burke
2003/0079604 A1 5/2003 Seo

(56) References Cited

U.S. PATENT DOCUMENTS

| | | | |
|---|---|---|---|
| 2003/0118104 | A1 | 6/2003 | Zaccarin |
| 2004/0213677 | A1 | 10/2004 | Matzner et al. |
| 2004/0219040 | A1 | 11/2004 | Kugelev et al. |
| 2004/0244577 | A1 | 12/2004 | Haughom |
| 2006/0029502 | A1 | 2/2006 | Kugelev et al. |
| 2007/0041847 | A1 | 2/2007 | Inoue et al. |
| 2007/0041849 | A1 | 2/2007 | Allen |
| 2007/0099746 | A1 | 5/2007 | Hahlbeck |
| 2007/0144842 | A1 | 6/2007 | Zhou |
| 2008/0006148 | A1 | 1/2008 | McKelroy |
| 2008/0078583 | A1 | 4/2008 | Cummins |
| 2008/0213115 | A1 | 9/2008 | Hilger et al. |
| 2008/0271562 | A1 | 11/2008 | Yasuhara et al. |
| 2009/0084260 | A1 | 4/2009 | Christopher |
| 2009/0092510 | A1 | 4/2009 | Williams et al. |
| 2010/0044028 | A1 | 2/2010 | Brooks |
| 2010/0129245 | A1 | 5/2010 | Patel et al. |
| 2010/0129249 | A1 | 5/2010 | Bianchi et al. |
| 2010/0158726 | A1* | 6/2010 | Donald ..... F04B 9/045 417/437 |
| 2010/0160710 | A1 | 6/2010 | Strickland |
| 2010/0172778 | A1 | 7/2010 | Kugelev et al. |
| 2010/0242720 | A1 | 9/2010 | Matzner et al. |
| 2010/0260631 | A1 | 10/2010 | Kugelev et al. |
| 2010/0322802 | A1 | 12/2010 | Kugelev |
| 2012/0141305 | A1 | 6/2012 | Landers et al. |
| 2012/0144995 | A1 | 6/2012 | Bayyouk et al. |
| 2012/0148430 | A1 | 6/2012 | Hubenschmidt et al. |
| 2012/0167759 | A1 | 7/2012 | Chinthan et al. |
| 2013/0064696 | A1 | 3/2013 | McCormick et al. |
| 2013/0206108 | A1 | 8/2013 | Schule et al. |
| 2013/0233165 | A1 | 9/2013 | Matzner et al. |
| 2014/0196570 | A1 | 7/2014 | Small et al. |
| 2015/0377318 | A1 | 12/2015 | Byrne |
| 2016/0025082 | A1 | 1/2016 | Byrne et al. |
| 2016/0025088 | A1 | 1/2016 | Byrne et al. |
| 2016/0025089 | A1 | 1/2016 | Kumar et al. |
| 2016/0025090 | A1 | 1/2016 | Bayyouk et al. |

FOREIGN PATENT DOCUMENTS

| | | | |
|---|---|---|---|
| CA | 2686204 | A1 | 5/2010 |
| CA | 2749110 | A1 | 7/2010 |
| CA | 153846 | S | 9/2014 |
| CN | 2436688 | Y | 6/2001 |
| CN | 2612816 | Y | 4/2004 |
| CN | 2674183 | Y | 1/2005 |
| CN | 2705626 | Y | 6/2005 |
| CN | 2758526 | Y | 2/2006 |
| CN | 1908435 | A | 2/2007 |
| CN | 2900853 | Y | 5/2007 |
| CN | 2926584 | Y | 7/2007 |
| CN | 200964929 | Y | 10/2007 |
| CN | 201092955 | Y | 7/2008 |
| CN | 101476558 | A | 7/2009 |
| CN | 101782067 | A | 7/2010 |
| CN | 201610828 | U | 10/2010 |
| CN | 201836038 | U | 5/2011 |
| CN | 201874803 | U | 6/2011 |
| CN | 102439314 | A | 5/2012 |
| CN | 103403351 | A | 11/2013 |
| CN | ZL2009100265839 | | 4/2014 |
| CN | ZL2013305556227 | | 5/2014 |
| CN | 105264275 | A | 1/2016 |
| DE | 975401 | C | 11/1961 |
| DE | 1191069 | B | 4/1965 |
| DE | 3234504 | A1 | 4/1983 |
| DE | 3441508 | A1 | 5/1986 |
| DE | 3802714 | A1 | 8/1988 |
| DE | 4416120 | A1 | 11/1995 |
| DE | 19653164 | A1 | 6/1998 |
| DE | 20120609 | U1 | 3/2002 |
| DE | 10129046 | A1 | 1/2003 |
| EP | 0300905 | A1 | 1/1989 |
| EP | 0449278 | A1 | 10/1991 |
| EP | 2397694 | A1 | 12/2011 |
| FR | 2618509 | A1 | 1/1989 |
| GB | 2342421 | A | 4/2000 |
| GB | 2419671 | A | 5/2006 |
| GB | 2482786 | A | 2/2012 |
| JP | 60175753 | A | 9/1985 |
| JP | 194453 | | 7/1990 |
| JP | 10288086 | A | 10/1998 |
| JP | 2920004 | B2 | 7/1999 |
| JP | 11200947 | A | 7/1999 |
| JP | 3974386 | B2 | 9/2007 |
| JP | 2008539364 | A | 11/2008 |
| KR | 1019990060438 | | 7/1999 |
| KR | 1019990079544 | | 11/1999 |
| KR | 100275877 | | 12/2000 |
| KR | 100287572 | | 6/2001 |
| KR | 1020010065249 | | 7/2001 |
| KR | 100302886 | | 11/2001 |
| KR | 1020010108223 | | 12/2001 |
| RU | 2037700 | C1 | 6/1995 |
| SG | D20131413-G | G | 3/2014 |
| WO | WO-2008137515 | A1 | 11/2008 |
| WO | WO-2010/080961 | A2 | 7/2010 |
| WO | WO-2010/080963 | A2 | 7/2010 |
| WO | WO-2011/005571 | A2 | 1/2011 |
| WO | WO-2012/092452 | A2 | 7/2012 |
| WO | WO-2013183990 | A1 | 12/2013 |
| WO | WO-2014143094 | A1 | 9/2014 |
| WO | WO-2015200810 | A2 | 12/2015 |
| WO | WO-2016014967 | A1 | 1/2016 |
| WO | WO-2016014988 | A1 | 1/2016 |
| WO | WO-2016015006 | A1 | 1/2016 |
| WO | WO-2016015012 | A1 | 1/2016 |

OTHER PUBLICATIONS

Final OA mailed May 7, 2008 re U.S. Appl. No. 10/831,467.
Examiner Interview Summary Jul. 17, 2008 re U.S. Appl. No. 10/831,467.
Office Action mailed Nov. 14, 2008 re U.S. Appl. No. 10/831,467.
Final OA mailed Jun. 24, 2009 re U.S. Appl. No. 10/831,467.
Examiner's Answer to Appeal Brief mailed Jan. 29, 2010 re U.S. Appl. No. 10/831,467.
Decision on Appeal mailed Feb. 20, 2013 re U.S. Appl. No. 10/831,467.
Notice of Allowance mailed Dec. 10, 2012 re U.S. Appl. No. 12/683,804.
Final Oa mailed Jul. 16, 2012 re U.S. Appl. No. 12/683,804.
Office Action mailed Jan. 27, 2012 re U.S. Appl. No. 12/683,804.
Office Action mailed Oct. 11, 2011 re U.S. Appl. No. 12/277,849.
Notice of Allowance mailed Dec. 23, 2011 re U.S. Appl. No. 12/277,849.
Supplemental Noa mailed Mar. 21, 2012 re U.S. Appl. No. 12/277,849.
Office Action mailed May 29, 2007 re U.S. Appl. No. 10/833,921.
Final OA mailed Sep. 18, 2007 re U.S. Appl. No. 10/833,921.
Examiner Interview Summary Apr. 10, 2008 re U.S. Appl. No. 10/833,921.
Office Action mailed Jul. 28, 2008 re U.S. Appl. No. 10/833,921.
Final OA mailed Jan. 21, 2009 re U.S. Appl. No. 10/833,921.
Advisory Action mailed Apr. 7, 2009 re U.S. Appl. No. 10/833,921.
Office Action mailed Jan. 18, 2013 re U.S. Appl. No. 12/748,127.
Office Action mailed Mar. 9, 2012 re U.S. Appl. No. 12/821,663.
Office Action mailed Apr. 19, 2012 re U.S. Appl. No. 12/821,663.
Intl Search Report re PCT/US2010/020447.
Written Opinion re PCT/US2010/020447.
PCT—IPRP re PCT/US2010/020447.
Intl Search Report re PCT/US2010/020445.
Written Opinion re PCT/US2010/020445.
PCT—IPRP re PCT/US2010/020445.
Intl Search Report and Written Opinion re PCT/US2010/039651.
PCT—IPRP re PCT/US2010/039651.
Canadian Office Action May 17, 2011 re 2,486,126.

(56) References Cited

OTHER PUBLICATIONS

Gardner Denver Well Servicing Pump Model C-2500Q Power End Parts List, Feb. 2009.
SPM QEM2500 GL Well Service Plunger Pump, Generic Operation Instruction and Service Manual, May 8, 2010.
MSI/Dixie Iron Works, Ltd., Technical Manual for 600 HP Triplex MSI TI-600 Pump, Rev. P, 102 pages, date unknown.
MSI/Dixie Iron Works, Ltd., Technical Manual for MSI Hybrid Well Service Pump Triplex and Quintuplex Models, Rev. D, 91 pages, date unknown.
International Search Report and Written Opinion (PCT/US2011/067770), dated Aug. 28, 2012.
Chinese OA dated Mar. 15, 2013 re app No. 200910226583.9.
International Search Report and Written Opinion mailed Sep. 5, 2013 in corresponding Application No. PCT/US2013/040106.
Chinese Office Action mailed Oct. 29, 2013, re Appl. No. 201080008236.X (22 pages).
Office Action mailed Jan. 2, 2014, by the USPTO, re U.S. Appl. No. 13/866,121 (27 pages).
Office Action mailed May 23, 2013, by the USPTO, re U.S. Appl. No. 12/683,900 (20 pages).
Office Action mailed Oct. 7, 2013, by the USPTO, re U.S. Appl. No. 13/843,525 (25 pages).
Australia Exam Report, by IP Australia, dated Feb. 9, 2015, re App No. 2011352095.
Canadian Exam Report, mailed Oct. 8, 2014, by CIPO, re App No. 2823213.
Canadian Examiner's Report, by CIPO, dated May 13, 2014, re App No. 153846.
Chinese Office Action, issued Sep. 2, 2014, by SIPO, re App No. 201080008236.X.
Election Requirement, mailed Nov. 18, 2014, by the USPTO, re U.S. Appl. No. 29/455,618.
Metaldyne, Torsional Vibration Dampers, Brochure.
Notice of Allowance, mailed Jan. 28, 2015, by the USPTO, re U.S. Appl. No. 29/455,618.
Office Action mailed Sep. 29, 2014, by the USPTO, re U.S. Appl. No. 13/339,640.
Suction Requirements for Reciprocating Power Pumps, p. 59, Figure 3.4 Composite Pump Dynamics.
International Preliminary Report on Patentability mailed Mar. 9, 2015 in corresponding PCT Application No. PCT/US13/40106, 9 pages.
Canadian Exam Report dated Jan. 11, 2016, by the CIPO, re App No. 2749110.
Canadian Exam Report dated Oct. 22, 2015, by the CIPO, re App No. 2686204.
Dirk Guth et al., "New Technology for a High Dynamical MRF-Clutch for Safe and Energy-Efficient Use in Powertrain," FISITA 2012 World Automotive Congress, Beijing, China, Nov. 27-30, 2012, 31 pages.
Simatec Smart Technologies, "Simatool Bearing Handling Tool BHT," Dec. 19, 2013.
International Search Report and Written Opinion, by the ISA/US, mailed Mar. 4, 2015, re PCT/US2014/069567.
International Search Report and Written Opinion, by the ISA/US, mailed Dec. 28, 2015, re PCT/US2015/042043.
International Search Report and Written Opinion, by the ISA/US, mailed Dec. 4, 2015, re PCT/US2015/042078, 11 pages.
International Search Report and Written Opinion, by the ISA/US, mailed Dec. 4, 2015, re PCT/US2015/042111.
International Search Report and Written Opinion, by the ISA/US, mailed Jun. 29, 2015, re PCT/US2015/014898.
International Search Report and Written Opinion, by the ISA/US, mailed Nov. 27, 2015, re PCT/US2015/038008.
International Search Report and Written Opinion, by the ISA/US, mailed Oct. 19, 2015, re PCT/US2015/042104.
International Search Report and Written Opinion, by the ISA/US, mailed Oct. 19, 2015, re PCT/US2015/042119.
Notice of Allowance mailed Feb. 12, 2016, by the USPTO, re U.S. Appl. No. 29/534,091.
Office Action/Restriction mailed Mar. 29, 2016, by the USPTO, re U.S. Appl. No. 14/565,962.
Office Action mailed Jun. 1, 2016, by the USPTO, re U.S. Appl. No. 14/565,962.
Office Action mailed Mar. 8, 2016, by the USPTO, re U.S. Appl. No. 14/262,880.
Canadian Examiner's Report dated Aug. 18, 2016, by the CIPO, re App No. 2905809.
*Estee Lauder Inc.* v. *L'Oreal*, USA, 129 F.3d 588, 44 U.S.P.Q.2d 1610, No. 96-1512, United States Court of Appeals, Federal Circuit, Decided Nov. 3, 1997.
International Preliminary Report on Patentability, by the IPEA/US, mailed Aug. 23, 2016 re PCT/US2013/042043.
International Preliminary Report on Patentability, by the IPEA/US, mailed Sep. 16, 2016 re PCT/US2015/042104.

* cited by examiner

RECIPROCATING PUMP ASSEMBLY

CROSS REFERENCE TO RELATED APPLICATION

This application is a continuation of co-pending application Ser. No. 13/843,525, filed Mar. 15, 2013, which is herein incorporated by reference in its entirety.

TECHNICAL FIELD

This invention relates to pump assemblies for well servicing applications, and in particular, to pump assemblies having two pumps mounted back-to-back on a platform for transport to and from a well-site.

BACKGROUND OF THE DISCLOSURE

In conventional drilling and completion of a well, cement is pumped into an annulus between a wellbore casing and the subterranean surface. Once the cement is sufficiently set, the cement can support and protect the casing from exterior corrosion and pressure changes.

A reciprocating or positive displacement pump is typically used for cementing and wellbore treatments and has three or five reciprocating element. The reciprocating pump includes a power end and fluid end section. The power end of the pump includes a housing having a crankshaft mounted therein. A connecting rod is connected to the crankshaft. The connecting rod includes a crankshaft end and a crosshead end. The crosshead end of the connecting rod is located in a cylinder and connected to a crosshead to reciprocatingly drive a plunger into the fluid end section.

The plunger typically extends through a wall of the power end section and into a wall of a manifold or fluid end section. A fluid seal contained within the fluid end section surrounds the plunger to prevent or limit fluid leakage into the power end housing. A power end seal contained within the power end section also surrounds the plunger at or near an opposed end of the plunger to prevent or limit fluid contamination into the power end section.

Reciprocating pumps can be mounted on a trailer or a skid in a back-to-back configuration. The overall width of the pumps, when configured in the back-to-back configuration, cannot exceed roadway requirements. For example, for travel on roads in the United States, the pumps cannot extend laterally across the trailer in a back-to-back configuration that is longer than 102 inches. Thus, in order to meet these width requirements, pumps have been designed with reduced sizes (i.e., the pumps are shortened, mounted closer together, designed with shorter stroke lengths, etc.), which oftentimes results in damage to the power end seal and contamination of the power end housing. For example, due to the shortened length of the pumps, fluid proppant oftentimes propagates along the plunger from the fluid end housing and contacts the power end seal, thereby damaging the power end seal and eventually contaminating the power end housing. Furthermore, such plungers and associated mounting component are susceptible to fatigue failure and/or high bending moments, which decreases the reliability of such pump assemblies. Thus, there is a need to for a pump design that can be mounted in a back-to-back configuration on a truck or skid type configuration in compliance with roadway requirements while also preventing and/or substantially eliminating damage to the power end seal, the plunger and the associated mounting components.

SUMMARY

In a first aspect, a reciprocating pump assembly is presented. The pump includes a power end housing, a fluid end housing and a cylinder having at least a portion within the power end housing. The fluid end housing has a vertical bore intersected by a crossbore such that the vertical bore includes a suction valve and a discharge valve to facilitate fluid flow through the fluid end housing. The pump further includes a plunger assembly reciprocating between the power end housing and the fluid end housing of the pump assembly. The plunger assembly has a crosshead, a first section secured to the crosshead that is limited to movement within the power end and a second section that is moveable within the crossbore of the fluid end housing. The second section is secured against the first section by a retainer member disposed inside the first and second sections. A seal housing is disposed within the cylinder and has a proximal end adjacent an entrance to the cylinder and a distal end disposed within the cylinder. A power end seal is secured to the seal housing proximate the distal end, and a fluid end seal is disposed within the crossbore of the fluid end housing. The power end seal sealingly engages an outer surface of the first section and the fluid end seal sealingly engages an outer surface of the second section such that during the reciprocating movement of the plunger assembly, fluid end proppant is deterred from contaminating the outer surface of the first section and thus, contaminating the power end seal.

In certain embodiments, the first section includes an outside diameter that is a different size from the second section outside diameter.

In other embodiments, the retainer member is configured to secure the first section and the second section to the cross-head.

In another embodiment, the retainer member is tensioned such that the second section compresses the first section against the crosshead.

In yet another embodiment, the retainer member is tensioned to a selected amount that is greater than typical fluid compressive forces acting on the retainer member and the crosshead to minimize fatigue in the retainer member.

In certain embodiments, the crosshead includes a recessed portion to receive at least a portion of the first section therein.

In other embodiments, the first section includes a bore therethrough, the bore configured to allow the retainer member to extend through the first section and at least partially into the second section.

In another embodiment, the retainer member includes a relief section extending between a first guide portion and a second guide portion, the relief section having a smaller diameter than the diameter of the first and second guide portions.

In yet another embodiment, the crossbore is disposed perpendicular to the vertical bore.

In a second aspect, a reciprocating pump assembly is presented. The pump includes a power end housing, a fluid end housing, a cylinder having at least a portion within the power end, a plunger assembly and a retainer member. The plunger assembly reciprocates between the power end housing and the fluid end housing of the pump assembly and includes a crosshead, a first section limited to movement within the power end and a second section moveable within the fluid end housing. The retainer member is disposed within the first and second sections, positioning the first and second sections against the crosshead to securely fasten the second section and the first section to the crosshead.

In certain embodiments, the crosshead includes a recessed portion, the first section disposed at least partially within the recessed portion.

In other embodiments, the crosshead includes a boss and the first section includes a counter bore sized to overlay the boss to create a sealing surface of increased length.

In another embodiment, the retainer member is threadingly secured to the second section.

In yet another embodiment, the retainer member is disposed within, and longitudinally extends through, the first section.

In certain embodiments, the retainer member is disposed along a central axis of the plunger assembly.

In other embodiments, the pump further includes a fluid end seal disposed within the fluid end housing such that the fluid end seal is adapted to sealingly engage an outer surface of the second section.

In another embodiment, the pump further includes a seal housing disposed within the cylinder such that the seal housing has a proximal end adjacent an entrance to the cylinder, and a distal end disposed within the cylinder, a power end seal is secured proximate the distal end to sealingly engage an outer surface of the first section.

In yet another embodiment, the first section includes an outside diameter that is the same size of an outside diameter of the second section.

In a third aspect, a reciprocating pump assembly includes a first pump and a second pump disposed in a back-to-back assembly having a width that is less than about 102 inches. Each of the first and second pump includes a power end housing, a fluid end housing, a cylinder having at least a portion within the power end, a plunger assembly, a seal housing, a power end seal and a fluid end seal. The plunger assembly reciprocates between the power end housing and the fluid end housing of the pump assembly and has a crosshead, a first section secured to the crosshead and limited to movement within the power end and a second section moveable within the fluid end housing. The second section is secured against the first section by a retainer member disposed inside the first and second sections. The seal housing is disposed within the cylinder and has a proximal end adjacent an entrance to the cylinder and a distal end disposed within the cylinder. The power end seal is secured to the seal housing proximate the distal end, and the fluid end seal is disposed within the fluid end housing. The power end seal sealingly engages an outer surface of the first section and the fluid end seal sealingly engages an outer surface of the second section such that during the reciprocating movement of the plunger assembly, fluid end proppant is deterred from contaminating the outer surface of the first section and thus, contaminating the power end seal.

In certain embodiments, the first section is formed having an outer diameter different than an outer diameter of the second section.

In other embodiments, the retainer member is configured to secure the first section and the second section to the cross-head.

Other aspects, features, and advantages will become apparent from the following detailed description when taken in conjunction with the accompanying drawings, which are part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
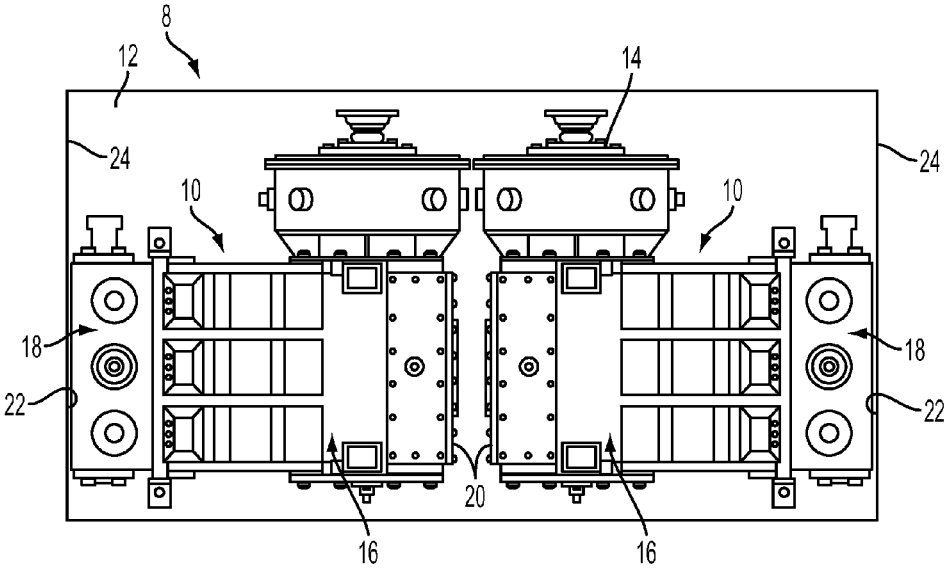
FIG. 1 is a schematic view of a pair of pumps mounted in a back-to-back configuration on a platform.

FIG. 1 is an illustration of a back to back pump assembly 8 according to one or more aspects of the present disclosure. In particular, FIG. 1 depicts a pair of pumps 10, such as, for example, reciprocating plunger pumps or a well service pumps, which are mounted in a back-to-back configuration on a platform 12 (e.g., a skid, truck bed, trailer, etc.). In the embodiment illustrated in FIG. 1, the pumps 10 are identical pumps although they may be of different types and/or inverted relative to one another. The pumps 10 together with a prime mover (not illustrated) are mounted on the platform 12 to provide a portable self-contained pumping assembly 8 that is easily transported to and from a well site for pumping operations. The prime mover is, for example, an electric motor or an internal combustion engine (e.g., a diesel engine) connected to a gear reducer 14 for reciprocating the pump assembly 10. In the embodiment illustrated in FIG. 1, the pumps 10 are depicted as triplex pumps; however, other types of pumps 10 (i.e., duplex, quintuplex, etc.) are suitable depending on the desired pumping requirements.

As illustrated in FIG. 1, the pumps 10 are compact in size to permit the pumps 10 to be oriented in a back-to-back assembly for legal travel on United States roadways when transported to and from well sites. For example, government regulations often provide vehicle width restrictions. In the depicted example, the width restriction is the same or smaller as the width of the platform 12 and is required to be 102 inches or less. Thus, the pump assembly 8 has an end-to-end length limitation of less than 102 inches.

Figure 2:
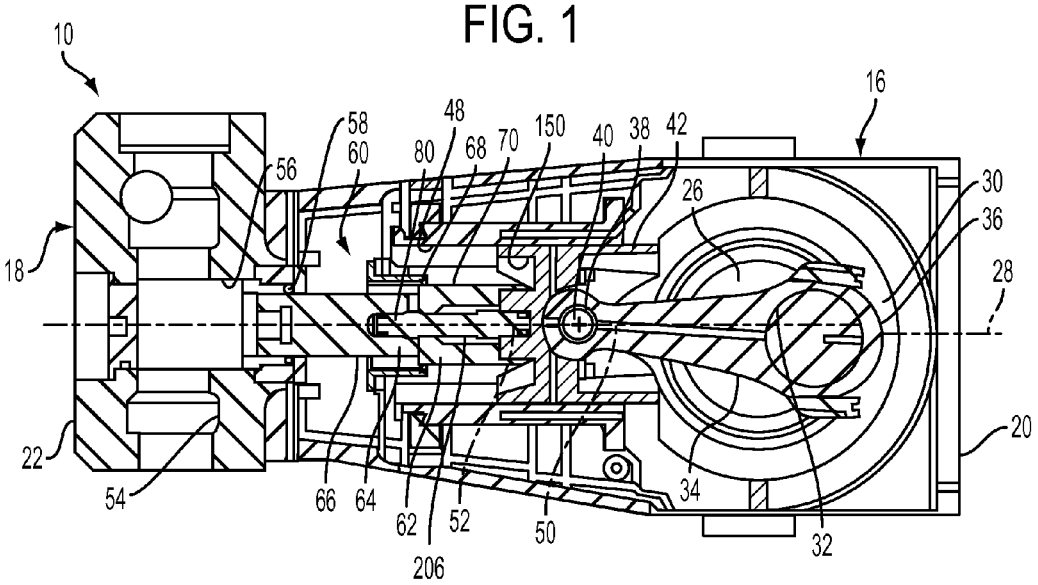
FIG. 2 is a sectional view of a pump of FIG. 1 in a fully retracted or bottom dead center position.
Figure 3:
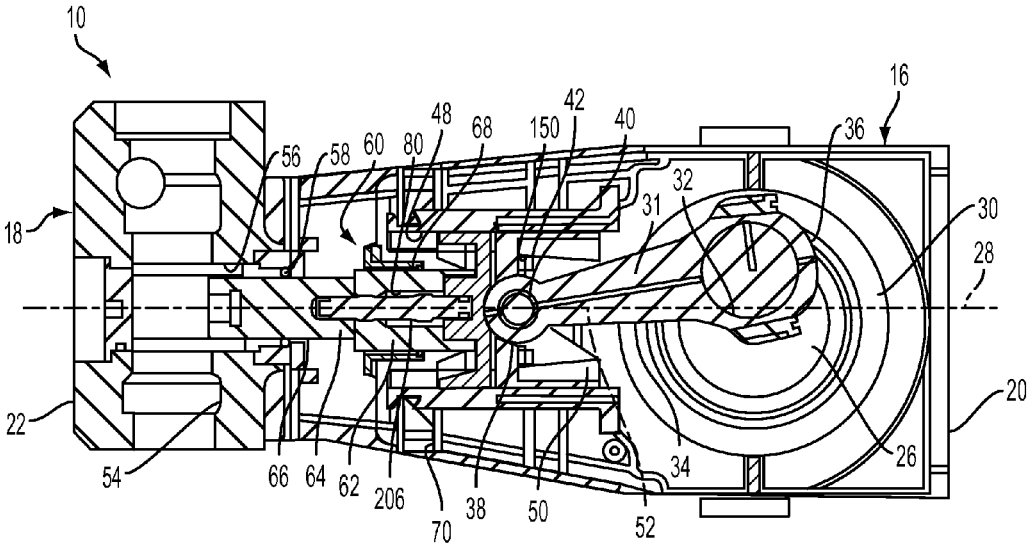
FIG. 3 is a sectional view of the pump assembly of FIG. 2 in a mid-cycle position.
Figure 4:
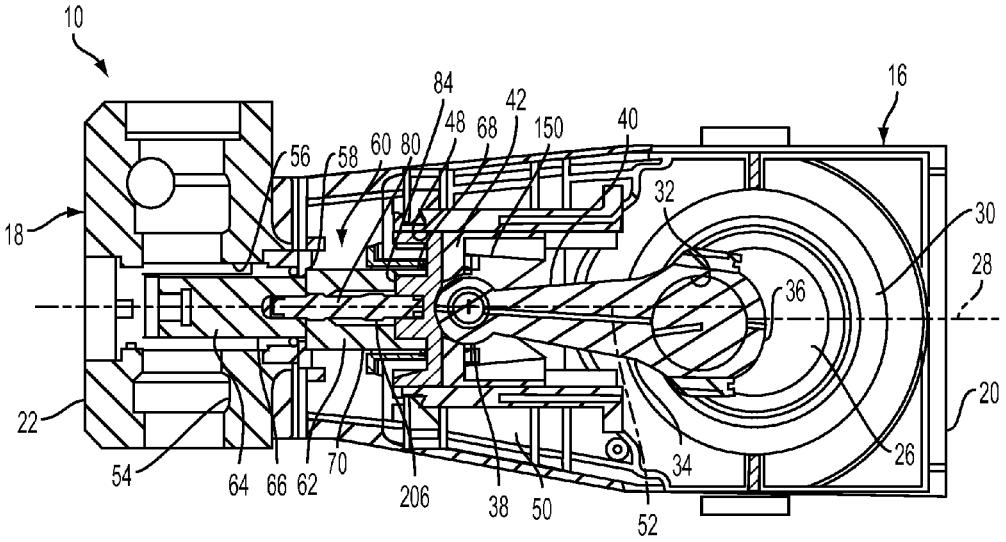
FIG. 4 is a sectional view of the pump assembly of FIG. 2 in a fully extended or top dead position

Referring now to FIGS. 1-4, at least one of the pump assemblies 10 includes a plunger assembly 60 operable between a fully retracted or bottom dead center position (FIG. 2), a mid-cycle position (FIG. 3), and a fully extended or top dead position (FIG. 4) for pumping fluid under high pressure into an oil or gas well, for example. Referring specifically to FIG. 2-4, pump assembly 10 includes a power end housing 16 coupled to a fluid end housing 18. Each pump 10 includes an inboard end 20 and an outboard end 22. For example, in FIGS. 2-4, the inboard end 20 is the terminal end, or edge, of the power end housing 16, and the outboard end 22 is the terminal end, or edge, of the fluid end housing 18. Thus, as illustrated in FIG. 1, the fluid end housings 18 are disposed at an outside lateral edge 24 of the platform 12 to facilitate easy access to the fluid end 18 for the connection of hoses and the like thereto.

The power end housing 16 for each pump 10 includes a crankshaft 26 rotatably mounted in the power end housing 16. The crankshaft 26 has a crankshaft axis 28 about which the crankshaft 26 rotates. The crankshaft 26 is mounted in the housing 16 with bearings 30 and is rotated via the gear train 14 (FIG. 1). The crankshaft 26 also includes a journal 32, which is a shaft portion to which a connecting rod 34 is attached.

In the embodiment illustrated in FIGS. 2-4, the connecting rod 34 includes a crankshaft end 36, which is connected to the crankshaft 26, and a crosshead end 38, which is rotatably connected to a wrist pin 40 of a crosshead 42. In operation, the crosshead 42 reciprocates within a cylinder 48 that is mounted in the power end housing 16. As illustrated in FIGS. 2-4, the wrist pin 40 includes a wrist pin axis 50 that is perpendicular to and located on (e.g., co-planar) a cylinder or central axis 52 (e.g., axis of reciprocation). In FIG. 2, for example, the pump includes an offset axis (i.e., wherein the wrist pin axis 50 and the cylinder axis 52 are offset from the crankshaft axis 28). Alternatively, the pump assembly includes a zero offset, whereby the cylinder axis 52, the wrist pin axis 50 and the crankshaft axis 28 are co-axially aligned.

The cylinder 48 is configured to receive at least a portion of the plunger assembly 60, which includes the crosshead 42 and a first or power end section 62 coupleable to a second or fluid end section 64. In operation, the power end section 62 is limited to movement within the power end housing 16 and the fluid end section 64 is movable within the fluid end housing 18. As illustrated in FIGS. 2-5, the power end section 62 includes an outer diameter that is different than the outer diameter of the fluid end section 64. For example, in FIGS. 2-5, the power end section 62 has a diameter that is larger than the diameter of the fluid end section 64. In one alternate embodiment, the outer diameter of the fluid end section 62 is equal to the outer diameter of the power end section 64. The segmented configuration (i.e., the separate power end and fluid end sections 62 and 64), including the differing sized diameters of the power end section 62 and the fluid end section 64 and/or a gap or seam 65 (FIG. 5) that is formed between the abutting sections 62 and 64, both act to prevent contamination of the power end section 62 by fluid end media.

The fluid end housing 18 is configured to receive suction and discharge valves (not illustrated) that are in fluid communication with a vertical bore 54 that is intersected by a crossbore 56. A fluid end seal 58 is disposed generally adjacent an entrance to the crossbore 56 of the fluid end housing 18. In the embodiment illustrated in FIG. 2, the fluid seal 58, typically in the form of an O-ring, is positioned within the crossbore 56 to form a fluid seal between the inner diameter of fluid end housing 18 and the outer diameter/surface 66 of the fluid end section 64.

In operation, a plunger assembly 60 reciprocates between the power end housing 16 and the fluid end housing 18 of the pump assembly 10. A power end seal 68 sealingly engages an outer surface 70 of the power end section 62 and, as discussed above, the fluid end seal 58 sealingly engages the outer surface 66 of the fluid end section 64. Such separate sealing surfaces prevent, during the reciprocating movement of the plunger assembly 60, cross contamination of the respective surfaces 66 and 70. In particular, this specific configuration prevents the travel of proppant from the fluid end section 64 to the power end section 62, which over time, deteriorates and degrades the power end seal 68, and ultimately contaminates the power end housing 16.

Figure 5:
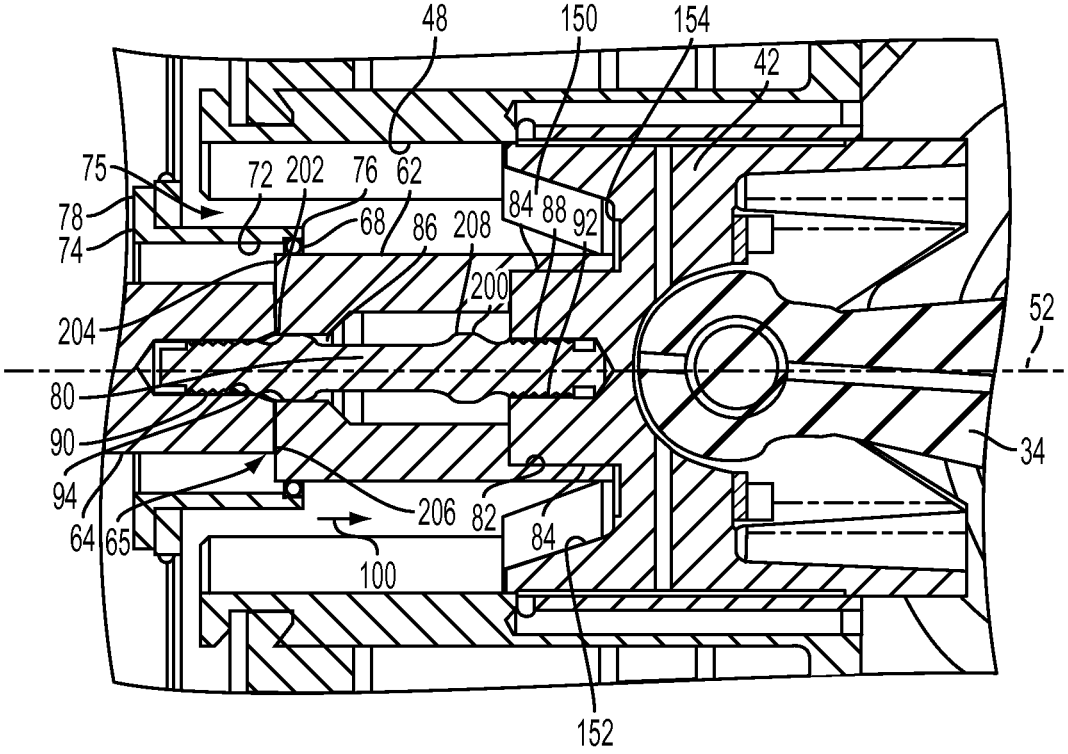
FIG. 5 is an enlarged view of a portion of the pump assembly of FIGS. 2-4.

As shown in FIG. 5, for example, the power end seal 68 is secured to a seal housing 72, which is disposed within the cylinder 48. The seal housing 72 includes a proximal end 74 adjacent an entrance 75 of the cylinder 48, and a distal end 76 that is disposed within the cylinder 48 and otherwise spaced apart from the entrance 75. The seal housing 72 is secured to the power end housing 16 via a flange 78. As illustrated in FIG. 5, the power end seal 68 is secured to the housing 72 at the distal end 76 such that the seal 68 is spaced apart from the entrance 75 of the cylinder 48. This configuration allows the stroke length to be increased such that during reciprocation of the plunger assembly 60, the fluid end section 64 is able to travel within the power end section 62, and in particular, within the seal housing 72, without contacting the power end seal 68, even if specific configurations of the plunger assembly 60 have identical outer diameters for the power end section 62 and the fluid end section 64.

As illustrated in FIGS. 2-5, the crosshead 42 includes a recessed portion 150 that is formed on a fluid facing end (i.e., the side of the crossbore that faces the fluid end housing 18). The recessed portion 150 is formed such that a boss 84 extends therein to receive the power end section 62 of the plunger assembly 60. As illustrated in FIG. 5, for example, the recessed portion 150 extends into the crosshead 42 and is formed by an outer wall 152 and an end wall 154 and is recessed a sufficient distance such that a portion of the power end section 62 extends therein. Accordingly, the recessed portion 150 is sized such that during operation, and in particular, when the pump assembly 10 is in the top dead position (FIG. 3), the recessed portion 150 accommodates and/or otherwise receives at least a portion of the seal housing 72 to allow a lengthened stroke by increasing a sealing surface between the outer surface 70 of the power end section 62 with the power end seal 68 so as to prevent proppant from propagating inside the power end housing 16.

According to some embodiments disclosed herein, in order to maintain separate sealing surfaces 62 and 64 during reciprocation of the plunger assembly, the length of the power end section 62 is approximately equal to the stroke length plus two times the length of the power end seal 68. Likewise, the length of the fluid end section is one and a half times the stroke length of the pump assembly 10. According to embodiments disclosed herein, the stroke length of pump assembly 10 is at least six inches; however, the stroke length is otherwise variable depending on the size of the pump assembly 10. For example, in some embodiments, the stroke length is approximately 8 inches, in other embodiments, the stroke length is less than six inches.

Referring specifically to FIG. 5, the plunger assembly 60 is secured to the crosshead 42 via a retainer member 80. Briefly, the plunger assembly 60, and in particular, the power end section 62 includes a counterbore 82 that is sized to receive and/or otherwise overlay the boss 84. The power end section 62 includes a corresponding bore or throughhole 86 such that the retainer member 80 extends therethough and at least partially into the fluid end section 64 of the plunger assembly 60. As seen in FIG. 5, for example, the retainer member 80 includes threaded ends 88 and 90 that are configured to threadingly engage bores 92 and 94 of the crosshead 42 and the fluid end section 64, respectively. The retainer member 80, when installed through the plunger assembly 60, is aligned on the axis 52 of the plunger assembly 60 and is configured to compress the power end section 62 and the fluid end section 64 against the crosshead 42 in order to securely fasten the fluid end section 62 and the power end section 64 to the cross head 42. For example, when assembling the plunger assembly 60, the counterbore 82 is aligned with and inserted over the boss 84 of the crosshead 42. The retainer member 80 is inserted through the throughole 86 of the power end section 62 and threadingly secured to the bore 92 such that the threaded end 90 of the retainer member 80 is exposed and extends from the power end section 62. Once sufficiently tightened, the fluid end section 64 is secured to the exposed threaded end 90 of the retainer member 80. In particular, the threaded bore 94 of the fluid end section 64 is aligned with and secured to the plunger assembly 60 by threadingly engaging the retainer member 80. The fluid end section 64 is tightened onto the threaded end 90, which tensions the retainer member 80. Such tensioning of the retainer member 80 causes the fluid end section 64 to move in the direction of arrow 100 in order to compress or otherwise "sandwich" the power end section 64 against the crosshead 42.

In FIG. 5, the retainer member 80 includes enlarged guide portions 200 and 202, which are employed to facilitate alignment of the power end section 62 with the central axis 52. In particular, as the retainer member 80 is secured to the crosshead 42, guide portion 202, includes an outer diameter sized to be slightly smaller than the inner diameter of the throughhole 86 at a terminal end 206 of the power end section 62. These close tolerances effectively guide and/or otherwise support the power end section 62 in a generally horizontal position so that the a central axis of the power end section 62 is generally aligned with the central axis 52.

The retainer member 80 includes a relief or mid-section 206, which extends between the enlarged guide portions 200 and 202. The relief section 206 includes a diameter that is smaller than the diameter of the enlarged guide portions 200 and 202 so as to enable deformation of the retainer member 80 along the cylinder axis 52 in response to tensioning the retainer member 80. For example, as the fluid end section 64 is tightened and compresses the power end section 62 against the crosshead 42, the retainer member 80 is tensioned such that it is deformed and/or otherwise "stretched" generally along the relief section 206. As such, the tensioned retainer member 80 is configured to accommodate and counter the compressive forces that result from high fluid pressures generated in the fluid end housing 18, which act on and are otherwise transmitted through the fluid end section 64 against the crosshead 42. In particular, the tensioned retainer member 80 is able to effectively counter the compressive forces exerted on the retainer member 80 in order to minimize fatigue failure of the retainer member 80 and thus, the failure of the plunger assembly 60. For example, the retainer member 80 is, as described above, tensioned a selected amount that is greater than the typical fluid compressive forces acting on the retainer member 80 and crosshead 42 generated from the fluid end housing 18. As such, the retainer member 80 is always in a "tensioned" state, rather than alternating between a tensioned and compressed state, since the tension force is greater than the highest compressive force. This configuration substantially eliminates the likelihood of fatigue failure of the retainer member 80 resulting from prolonged operation of the pump assembly 10.

In addition to the above, the retainer member 80 is sized and shaped to accommodate bending moments acting on the plunger assembly 60. For example, in the event the plunger becomes misaligned with the cylinder axis 52 due to, for example, forces acting on the fluid end 64 section during pumping, the relief section 206 is shaped and sized to bend or otherwise "flex" to accommodate the bending moment acting on the plunger assembly 60.

Embodiments provided herein include a method of manufacturing a reciprocating pump assembly 10. The method includes forming or otherwise installing the cylinder 48 in the power end housing 16 and inserting a plunger assembly 60 for reciprocating movement within the cylinder 48, the plunger assembly 60 including the crosshead 42, the power end section 62 and the fluid end section 64. The method also includes securing the seal housing 72 in the cylinder 48 such that the proximal end 74 of the seal housing 72 is disposed adjacent the entrance 75 to the cylinder 48 and the distal end 76 is disposed within the cylinder 48. The method further includes securing the power end seal 68 proximate the distal end 76 of the seal housing 72 and securing a fluid end seal 58 within the fluid end housing 18 such that the power end seal 68 sealingly engages an outer surface 70 of the power end section 62 and the fluid end seal 58 sealingly engages the outer surface of the fluid end section 66 such that during the reciprocating movement of the plunger assembly 60, fluid end proppant is deterred from contaminating the outer surface 70 of the power end section 62 and thus, contaminating the power end seal 68.

The various embodiments and aspects described herein provide multiple advantages such as, for example, preventing or substantially reducing the likelihood of fluid end proppant propagating from the fluid end 16 to the power end 18 via the configuration of the plunger assembly 60 having the gap or seam 65 that redirects fluid proppant from passing from the fluid end section 64 to the power end section 62. Furthermore, embodiments illustrated herein provide separate sealing surfaces (i.e., the power end seal 68 contacting the power end section 62 and the fluid end seal 58 only contacting the fluid end section 64) due to, for example, the recessed power end seal 68 and the recessed portion 150 on the crosshead 52. Furthermore, embodiments of the retainer member 80 enable the plunger assembly to withstand bending moments associated with the misalignment of the plunger assembly 60 and the compressive forces generated in the fluid end housing 18.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments and it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A reciprocating pump assembly, comprising:

a power end housing;

a fluid end housing having a vertical bore intersected by a crossbore, the vertical bore including a suction valve and a discharge valve to facilitate fluid flow through the fluid end housing;

a cylinder having at least a portion within the power end;

a plunger assembly reciprocating between the power end housing and the fluid end housing of the pump assembly, the plunger assembly having a crosshead, a first section secured to the crosshead and limited to movement within the power end and a second section moveable within the crossbore of the fluid end housing, the second section secured against the first section by a retainer member disposed inside the first and second sections;

a seal housing disposed within the cylinder, the seal housing having a proximal end adjacent an entrance to the cylinder, and a distal end disposed within the cylinder, a power end seal secured to the seal housing proximate the distal end;

a fluid end seal disposed within the crossbore of the fluid end housing;

wherein the power end seal sealingly engages an outer surface of the first section and the fluid end seal sealingly engages an outer surface of the second section such that during the reciprocating movement of the plunger assembly, fluid end proppant is deterred from contaminating the outer surface of the first section and thus, contaminating the power end seal; and wherein the retainer member is configured to secure the first section and the second section to the cross-head.

2. The pump assembly of claim 1, wherein the first section includes an outside diameter that is a different size from the second section outside diameter.

3. The pump assembly of claim 1, wherein the retainer member is tensioned such that the second section compresses the first section against the crosshead.

4. The pump assembly of claim 3, wherein the retainer member is tensioned to a selected amount greater than typical fluid compressive forces acting on retainer member and the crosshead to minimize fatigue in the retainer member.

5. The pump assembly of claim 1, wherein the crosshead includes a recessed portion to receive at least a portion of the first section therein.

6. The pump assembly of claim 1, wherein the first section includes a bore therethrough, the bore configured to allow the retainer member to extend through the first section and at least partially into the second section.

7. The pump assembly of claim 6, wherein the retainer member includes a relief section extending between a first guide portion and a second guide portion, the relief section having a smaller diameter than the diameter of the first and second guide portions.

8. The pump assembly of claim 1, wherein crossbore is disposed perpendicular to the vertical bore.

9. The reciprocating pump of claim 1, wherein the retainer member is disposed within, and longitudinally extends through, the first section.

10. A reciprocating pump assembly, comprising:

a power end housing and a fluid end housing;

a cylinder having at least a portion within the power end;

a plunger assembly reciprocating between the power end housing and the fluid end housing of the pump assembly, the plunger assembly having a crosshead, a first section limited to movement within the power end and a second section moveable within the fluid end housing;

a retainer member disposed within the first and second sections, the retainer member positioning the first section against the second section and further, positioning the first section against the crosshead to securely fasten the second section and the first section to the crosshead.

11. The pump assembly of claim 10, wherein the crosshead comprises a recessed portion, the first section disposed at least partially within the recessed portion.

12. The pump assembly of claim 10, wherein the crosshead comprises a boss and the first section includes a counter bore sized to overlay the boss to create a sealing surface of increased length.

13. The pump assembly of claim 10, wherein the retainer member is threadingly secured to the second section.

14. The pump assembly of claim 10, wherein the retainer member is disposed within, and longitudinally extends through, the first section.

15. The pump assembly of claim 10, wherein the retainer member is disposed along a central axis of the plunger assembly.

16. The pump assembly of claim 10, further comprising a fluid end seal disposed within the fluid end housing, the fluid end seal adapted to sealingly engage an outer surface of the second section.

17. The pump assembly of claim 16, further comprising a seal housing disposed within the cylinder, the seal housing having a proximal end adjacent an entrance to the cylinder, and a distal end disposed within the cylinder, a power end seal secured proximate the distal end to sealingly engage an outer surface of the first section.

18. The pump assembly of claim 10, wherein the first section includes an outside diameter that is the same size of an outside diameter of the second section.

19. A reciprocating pump assembly, the assembly comprising a first pump and a second pump disposed in a back-to-back assembly having a width that is less than or equal to 102 inches, each of the first and second pump comprising:

a power end housing and a fluid end housing;

a cylinder having at least a portion within the power end;

a plunger assembly reciprocating between the power end housing and the fluid end housing of the pump assembly, the plunger assembly having a crosshead, a first section secured to the crosshead and limited to movement within the power end and a second section moveable within the fluid end housing, the second section secured against the first section by a retainer member disposed inside the first and second sections;

a seal housing disposed within the cylinder, the seal housing having a proximal end adjacent an entrance to the cylinder, and a distal end disposed within the cylinder, a power end seal secured to the seal housing proximate the distal end;

a fluid end seal disposed within the fluid end housing;

wherein the power end seal sealingly engages an outer surface of the first section and the fluid end seal sealingly engages an outer surface of the second section such that during the reciprocating movement of the plunger assembly, fluid end proppant is deterred from contaminating the outer surface of the first section and thus, contaminating the power end seal; and wherein the retainer member is configured to secure the first section and the second section to the cross-head.

20. The reciprocating pump assembly of claim 19, wherein the first section is formed having an outer diameter different than an outer diameter of the second section.

* * * * *